US006235090B1

(12) United States Patent
Bernstein et al.

(10) Patent No.: US 6,235,090 B1
(45) Date of Patent: May 22, 2001

(54) KITCHEN HOOD FILTRATION APPARATUS

(75) Inventors: Samuel Bernstein, Bellevue; Gerald S. Knoke, Kent, both of WA (US)

(73) Assignee: Gas Research Institute, Chicago, IL (US)

( * ) Notice: Subject to any disclaimer, the term of this patent is extended or adjusted under 35 U.S.C. 154(b) by 0 days.

(21) Appl. No.: 09/222,490

(22) Filed: Dec. 29, 1998

(51) Int. Cl.[7] ..... B03C 3/011

(52) U.S. Cl. ..... 96/57; 55/DIG. 36; 96/63; 96/64

(58) Field of Search ..... 96/55–59, 64, 96/63, 66; 55/DIG. 36

(56) References Cited

U.S. PATENT DOCUMENTS

| | | | | |
|---|---|---|---|---|
| 3,785,124 | * | 1/1974 | Gaylord | 96/55 X |
| 3,979,193 | | 9/1976 | Sikich | 55/DIG. 30 |
| 4,411,254 | * | 10/1983 | Field et al. | 96/55 X |
| 4,451,435 | | 5/1984 | Hölter et al. | 422/171 |
| 4,489,647 | | 12/1984 | Stamps et al. | 99/336 |
| 4,505,194 | | 3/1985 | Bishop et al. | 99/336 |
| 4,551,304 | | 11/1985 | Hölter et al. | 422/4 |
| 4,655,194 | * | 4/1987 | Wooden | 55/DIG. 36 |
| 4,853,735 | | 8/1989 | Kodama et al. | 355/215 |
| 4,854,949 | | 8/1989 | Giles, Sr. et al. | 55/DIG. 36 |
| 4,902,316 | * | 2/1990 | Giles, Sr. et al. | 55/DIG. 36 |
| 5,055,115 | | 10/1991 | Yikai et al. | 96/97 X |
| 5,063,906 | * | 11/1991 | Rogers et al. | 55/DIG. 36 |
| 5,087,943 | | 2/1992 | Creveling | 55/472 X |
| 5,154,161 | * | 10/1992 | Rogers et al. | 55/DIG. 36 |
| 5,249,510 | | 10/1993 | Rozak et al. | 99/336 |
| 5,556,448 | | 9/1996 | Cheney et al. | 95/6 |
| 5,704,955 | | 1/1998 | Giles | 96/26 X |

FOREIGN PATENT DOCUMENTS

| | | | | |
|---|---|---|---|---|
| 2459356 | * | 6/1975 | (DE) | 96/55 |
| 2719035 | * | 11/1977 | (DE) | 96/55 |
| 2920813 | * | 12/1980 | (DE) | 96/55 |
| 556847 | * | 8/1993 | (EP) | 96/55 |
| 6-126210 | * | 5/1994 | (JP) | 96/55 |

OTHER PUBLICATIONS

Dr. Stu Knoke, "Feasibility of Applying Innovative Electrostatic Precipitator Technology to Commercial Kitchen Ventilation", Energy International, Inc., Report No. B9760001, Jan. 1998.

"Operations and Service Manual, (Modes FSH–2 and FSH–2A)", Giles Food Service Equipment, Giles Enterprises, Inc., Montgomery, Alabama, Form No. 64916 (Jul. 1998).

Harry J. White, "Industrial Electrostatic Precipitation", Addison–Wesley, 1963, pp. 33–87.

* cited by examiner

*Primary Examiner*—Richard L. Chiesa
(74) *Attorney, Agent, or Firm*—Pauley Petersen Kinne & Fejer

(57) ABSTRACT

A kitchen hood filtration system having improved odor removal properties includes an electrostatic precipitator having negative corona which generates ozone. The ozone interacts with odor-producing moieties to help eliminate the odors. The filtration system also includes a grease remover, an odor remover which utilizes the ozone, and a fan which drives kitchen effluent through the hood filtration system.

15 Claims, 2 Drawing Sheets

KITCHEN HOOD FILTRATION APPARATUS

FIELD OF THE INVENTION

This invention is directed to a kitchen hood filtration apparatus which removes cooking odors and collects particles, oil mist, grease droplets and water fog resulting from the cooking of food. The kitchen hood filtration apparatus produces sufficiently clean exhaust air which can be returned to the kitchen.

BACKGROUND OF THE INVENTION

Electronic air cleaners have been used in the restaurant industry for many years. Electronic air cleaners have been used both to purify outside air drawn into the restaurant, and to clean exhaust cooking air so that it can be discharged outdoors. However, it has been difficult to remove all particles, oil and grease droplets, vapors and odors from commercial cooking effluent so that the exhaust can be returned directly to the room.

Conventional hood filtration systems used in commercial kitchens employ electronic air cleaners for removal of particles from the air. These electronic air cleaners do not adequately remove vapor and odors. The conventional electronic air cleaners use a positive corona (electrodes with positive polarity) to minimize ozone production.

Attempts have been made to remove vapors and odor by placing charcoal granular beds downstream from the electronic air cleaner. The charcoal beds have not proven effective in odor removal, and instead emit rancid odors when not frequently replaced. Other kitchen hood systems employ baffles and chemical baths to remove grease, vapor and odors. These systems require high maintenance, and have not proven effective in removing odors. Absent frequent maintenance, the performance of these hood systems deteriorates rapidly.

SUMMARY OF THE INVENTION

The present invention is a kitchen hood filtration system which removes particles, oil mist, grease droplets, water fog and cooking odors from cooking effluent, producing clean exhaust air which can be returned directly to a kitchen, room and/or restaurant. The filtration system includes four significant components. These are a baffle filter, an electronic precipitator which generates ozone using negative corona, an odor removal device which uses the ozone, and an exhaust fan.

The electrostatic precipitator having negative corona (produced by electrodes with negative polarity) generates a significant amount of ozone which, in effect, substantially reduces the rancid grease odor emitted by many conventional hood systems. Other odors are also removed by the oxidation effect of the ozone. Additionally, the negative corona is more stable than positive corona, permitting higher voltage operation of the precipitator to facilitate more efficient particle collection.

The odor removal device uses the ozone generated by the corona, and destroys the ozone. The odor removal device may include a charcoal filter, a positive corona device, or a charcoal filter combined with a positive electrostatic field. During the deodorizing process, the ozone is converted to oxygen. Some of the ozone reacts with and oxidizes odor-producing compounds to eliminate their odor. Any excess ozone is converted to free oxygen.

The baffle filter and exhaust fan may be conventional. The baffle filter removes most grease and oil droplets. Unlike a conventional apparatus, the exhaust fan may be directed to return clean exhaust air to the kitchen and/or restaurant which is the source of the kitchen effluent.

With the foregoing in mind, it is a feature and advantage of the invention to provide an improved kitchen hood filtration system which combines a conventional baffle filter and exhaust fan with an ozone-producing negative corona electrostatic precipitator, and an odor removal device which uses the ozone to eliminate odor, and converts excess ozone to atmospheric oxygen.

It is also a feature and advantage of the invention to provide an integrated kitchen hood filtration system that removes odors from cooking effluent as well as particles, oil mist, grease droplets and water fog.

The foregoing and other features and advantages will become further apparent from the following detailed description of the presently preferred embodiments, read in conjunction with the accompanying drawings. The detailed description and drawings are merely illustrative rather than limiting, the scope of the invention being defined by the appended claims and equivalents thereof.

DETAILED DESCRIPTION OF THE PRESENTLY PREFERRED EMBODIMENTS

Figure 1:
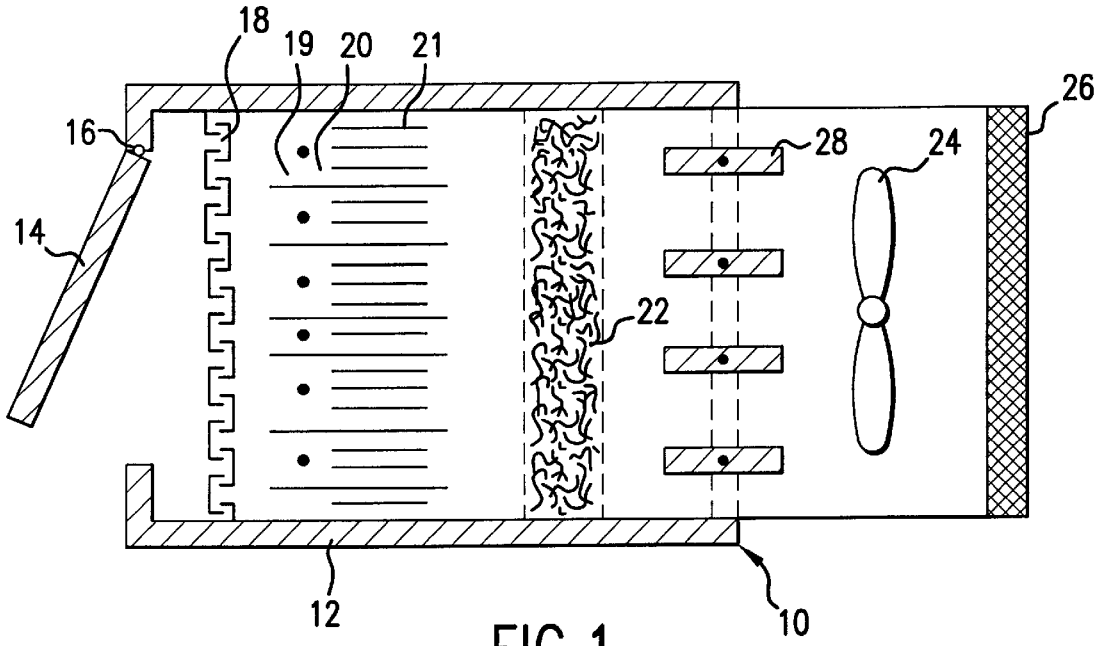
FIG. 1 schematically illustrates a kitchen hood system of the invention.

FIG. 1 illustrates a kitchen hood filtration system of the invention which can, for instance, be used in a hood above an oven. The hood filtration system 10 may include insulated outer walls 12, and an insulated door 14 which swings open along a pivot 16 when the filtration system is to receive effluent from an oven (not shown).

The filtration system 10 includes a baffle assembly 18, an ozone-generating electrostatic precipitator 20, an odor removal device 22 (in this case, a charcoal filter), a suction exhaust fan 24 which pulls the oven effluent through the filter, and a conventional high efficiency furnace filter 26 leading to an exhaust vent. A plurality of pivotally mounted louvers 28 shown in the open position for operation of the filtration system, can be closed during cleaning of the filtration system. The louvers 28 are located downstream from odor removal device 22, and upstream from the exhaust fan 24.

The baffle assembly 18 can be a conventional baffle filter and is used for collecting large grease and oil droplets, as well as large particles. Moisture and other vapors may also condense on the baffle assembly, which includes one or more baffles. The baffle filter 18 may be constructed of aluminum, stainless steel, copper, brass, another suitable metal, or another suitable material. A suitable aluminum baffle filter for filtering grease is described in U.S. Pat. No. 4,854,949, issued to Giles, Sr. et al., the disclosure of which is incorporated by reference.

Figure 2:
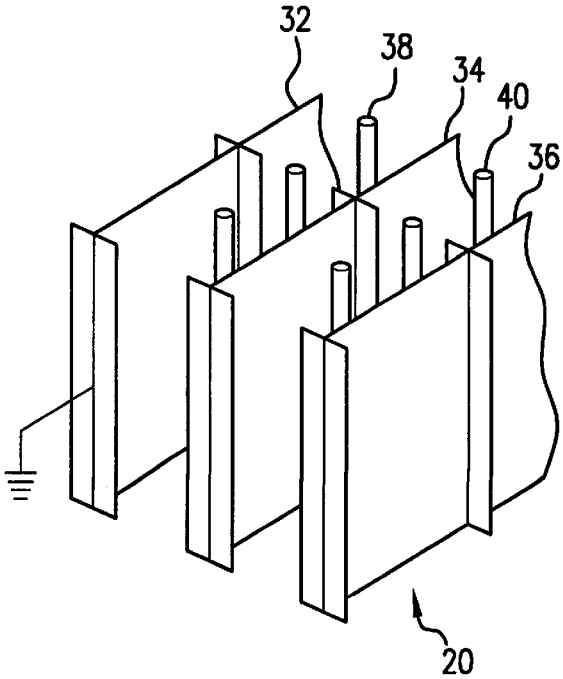
FIG. 2 schematically illustrates an electrostatic precipitator having negative corona discharge, useful in the kitchen hood system of the invention.

The electrostatic precipitator 20 is preferably a negative corona-type precipitator which generates ozone. The additional ozone generated by the negative corona chemically reacts with odor-producing moieties, causing oxidation which eliminates the odors. Referring to FIG. 2, an electrostatic precipitator 20 may include three parallel plate electrodes 32, 34 and 36. A first set 38 of discharge wire electrodes is located between plates 32 and 34, and a second set 40 of discharge wire electrodes is located between plates 34 and 36. The plates and wires operate together as a generator of negative corona. High voltage direct current corona is established between the wires 38 and 40, which are maintained at high voltage, and the smooth plate electrodes 32, 34 and 36, which are maintained at ground potential. The wires and plates are made of a conductive metal or other material.

Under these conditions, the corona is manifested by a highly active visible glow in the region of strong electric field near the wire surfaces. Large numbers of positive and negative ions are formed in the active glow region. The wires 38 and 40 have negative polarity, causing the positive ions to be attracted to the wires, while the negative ions are attracted to the grounded plates 32, 34 and 36. Although both positive and negative ions are formed in the glow region near the wires, over 99% of the air space between the wires 38 and 40, and the plates 32, 34 and 36, contains only negative ions. Further description of negative corona electrostatic precipitators is found in a book by Harry J. White entitled "Industrial Electrostatic Precipitation" (Addison-Wesley, 1963) at pp. 33–87.

During operation, kitchen effluent is drawn between the parallel plates of precipitator 20 by action of the suction exhaust fan 24. Particles, and small droplets of grease and oil, not collected by the baffle filter, may be driven to the plates by the intense electric field of the corona, and collected at the plates. Alternatively, in a two-stage precipitator (FIG. 1), particles and droplets may become electrically charged in a first (corona) stage 19 and collected at plates in a second (non-corona) stage 21.

Higher voltage on the collector plates causes a higher particle drift velocity and, hence, a higher collection efficiency. This is one reason why negative corona, which operates at higher voltage than positive corona, is considered superior for purposes of the invention. Collectively, the baffle filter 18 and the electrostatic precipitator 20 remove particles, oil, grease, and water vapor from the kitchen effluent.

The negative corona of precipitator 20 generates triatomic oxygen (ozone), which reacts with odor-producing moieties in the effluent to neutralize them. The odor-removing device 22, which can include a conventional charcoal filter, removes residual odors from the effluent. In the past, the charcoal filter became so loaded with collected odor-producing moieties that the filter itself emanated a strong rancid odor unless frequently changed or cleaned. In accordance with the invention, some ozone generated by the corona passes to the charcoal filter and neutralizes the entrained odor-producing moieties, thereby prolonging the useful life of the filter and improving its effectiveness. As a result, the kitchen hood filter assembly 10 is able to operate for longer periods of time, yielding a clean exhaust gas which can be recycled to the kitchen and/or restaurant via the exhaust fan 24 and conventional furnace filter 26 (which removes any remaining particles or droplets that pass through the filter system 10).

The hood filter system 10 may be equipped with a self-cleaning feature. During operation, the entrance door 14 and louvers 28 are in the open position as shown in FIG. 1. To clean the system, the door 14 and louvers 28 are closed. Then, the filter system 10 is heated to an elevated temperature for a time sufficient to cook the grease in the baffles 18, precipitator 20 and odor-removing device 22, producing dehydrated particles and some carbon dioxide. For instance, the filter system 10 may be heated to about 900–1100° F. for about 3–4 hours. When the door 14 and louvers 18 are re-opened and the filter system 10 re-started, the particles should be collected by the high efficiency furnace filter 26, which can be periodically cleaned or replaced. Alternatively, the parts may be cleaned using known detergents and chemicals.

As another alternative to the self-cleaning feature, the hood filter system 10 of the invention may be equipped with removable and replaceable parts. For instance, the baffle filter 18, electrostatic precipitator 20, and odor removing device 22 may all be designed for periodic removal and replacement. The removed parts may be cleaned with heat, detergents or chemicals, and/or replaced. In this design, the door 14 and louvers 28 need not be included.

The odor-removing device 22 should substantially eliminate ozone emissions as well as residual odors. When the device 22 includes a charcoal filter, the ozone will generally be substantially eliminated by a) interaction with odor-producing moieties, and b) interaction with the charcoal filter. To provide further safeguard against ozone emissions, the odor-removing device 22 may also include one or more plates creating positive electostatic field within the charcoal filter, and/or positively polarized wire electrodes and grounded plate electrodes generating positive corona downstream of the charcoal filter. The positive electrostatic field or corona will convert any remaining ozone to simple diatomic oxygen.

In still another embodiment, the odor-removing device 22 may include the positive corona device (positively polarized wire electrodes and grounded plate electrodes) without a charcoal filter. In this embodiment, the ozone generated by the negative corona in the precipitator must be sufficient to substantially neutralize all odor-producing moieties, without assistance from a charcoal filter. Then, any remaining ozone can be neutralized by the positive corona device. In summary, the odor-removing device 22 may include a) a charcoal filter, b) a positive corona device or c) a charcoal filter and a positive electrostatic field.

Figure 3:
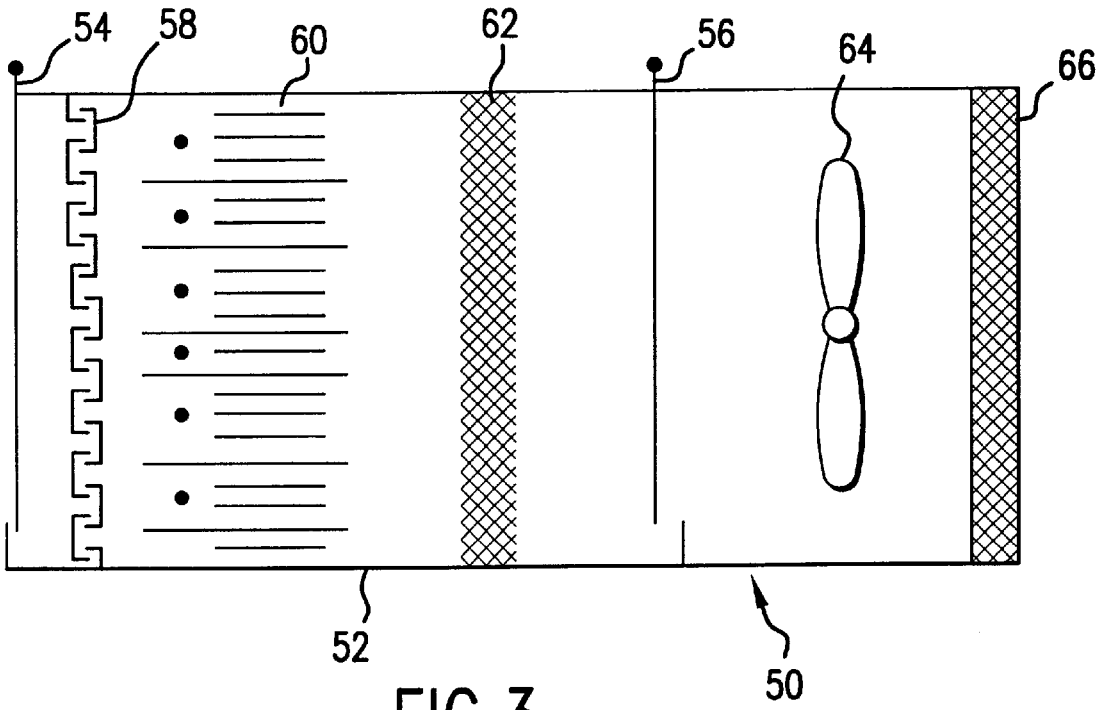
FIG. 3 schematically illustrates another embodiment of a kitchen hood system of the invention.

An alternative embodiment of the hood filter system is shown in FIG. 3. The filter system 50 shown in FIG. 3, may have non-insulated sheet metal walls 52, and sliding doors 54 and 56. During operation, doors 54 and 56 are open, and cooling effluent is pulled by suction fan 64 through the grease/vapor baffles 58, the ozonegenerating electrostatic precipitator 60, and the odor-removing filter 62 before being passed out through furnace filter 66. The doors 54 and 56 may be closed for cleaning of the filter system 50, using hot water, a detergent, and rotary spray arms (not shown). Alternatively, the filter parts may be removed and cleaned, as described above.

Other embodiments of the invention are also contemplated, with key features being the use of an ozone-generating precipitator followed by an odorremoving device which also neutralizes unreacted ozone.

While the embodiments of the invention disclosed herein are presently considered preferred, various modifications and improvements can be made without departing from the spirit and scope of the invention. The scope of the invention is indicated in the appended claims, and all changes that fall within the meaning and range of equivalents are intended to be embraced therein.

We claim:

1. A kitchen hood filtration system, comprising:

a baffle filter;

an ozone-generating electrostatic precipitator positioned downstream of the baffle filter;

a positive corona generating odor removal device positioned downstream of the electrostatic precipitator; and an exhaust fan positioned downstream of the positive corona generating odor removal device.

2. The kitchen hood filtration apparatus of claim 1, wherein the electrostatic precipitator comprises a negative corona generator which, in turn, produces ozone.

3. The kitchen hood filtration system of claim 2, wherein the negative corona generator comprises a plurality of negatively polarized wire electrodes and grounded plate electrodes.

4. The kitchen hood filtration system of claim 1, wherein the odor removal device comprises a charcoal filter.

5. The kitchen hood filtration system of claim 1, wherein the odor removal device comprises positively polarized wire electrodes and grounded plate electrodes.

6. The kitchen hood filtration system of claim 1, wherein the odor removal device comprises a charcoal filter and a positive electrostatic field.

7. The kitchen hood filtration system of claim 1, further comprising a high efficiency furnace filter.

8. The kitchen hood filtration system of claim 1, further comprising walls and doors which contain at least the baffle filter, the ozone-generating electrostatic precipitator, and the odor-removal device.

9. The kitchen hood filtration system of claim 8, wherein the walls and doors are insulated.

10. The kitchen hood filtration system of claim 9, wherein the baffle filter, the ozone-generating electrostatic precipitator, and the odor removal device are removably mounted.

11. A kitchen hood filtration system, comprising:

a grease filter;

an electrostatic precipitator having negative corona positioned downstream of the grease filter;

a positive corona generating odor removal device positioned downstream of the electrostatic precipitator which neutralizes ozone; and a suction fan positioned downstream of the positive corona generating odor removal device.

12. The kitchen hood filtration system of claim 11, wherein the grease filter comprises a baffle filter.

13. The kitchen hood filtration system of claim 11, wherein the negative corona causes ozone formation.

14. The kitchen hood filtration system of claim 11, wherein the odor removal device comprises a charcoal filter.

15. The kitchen hood filtration system of claim 11, wherein the odor removal device comprises a filter and a positive corona device.

* * * * *